United States Patent [19]

Fushiki et al.

[11] Patent Number: 4,609,039

[45] Date of Patent: Sep. 2, 1986

[54] COUNTERFLOW HEAT EXCHANGER

[75] Inventors: Takeo Fushiki; Koji Takahashi, both of Moriyama; Morio Okazaki, Yokohama, all of Japan

[73] Assignees: Japan Vilene Co. Ltd.; Toyo Netsukogyo Kaisha Ltd., Tokyo, Japan

[21] Appl. No.: 538,996

[22] Filed: Oct. 4, 1983

[30] Foreign Application Priority Data

Oct. 5, 1982 [JP] Japan ..... 57-175052

[51] Int. Cl.[4] ..... F28F 9/02; F28F 3/00

[52] U.S. Cl. ..... 165/174; 165/145; 165/158; 165/166; 55/158; 55/269

[58] Field of Search ..... 165/174, 165, 166, 158, 165/145; 55/158, 269

[56] References Cited

U.S. PATENT DOCUMENTS

| | | | |
|---|---|---|---|
| 1,740,145 | 12/1929 | Bates | 165/166 |
| 1,825,498 | 9/1931 | Wogan | 165/165 |
| 2,092,835 | 9/1937 | Edwards | 165/165 |
| 2,321,110 | 6/1943 | Shipman | 165/166 |
| 2,361,691 | 10/1944 | Jendrassik | 165/157 |
| 2,400,617 | 5/1946 | Wheller | 165/166 |
| 4,040,804 | 8/1977 | Harrison | 165/165 |
| 4,116,271 | 9/1978 | De Lepeleire | 165/166 |

FOREIGN PATENT DOCUMENTS

| | | | |
|---|---|---|---|
| 146192 | 5/1949 | Austria | 165/166 |
| 0010082 | 1/1982 | Japan | 165/165 |
| 40072 | 2/1937 | Netherlands | 165/157 |
| 900938 | 7/1962 | United Kingdom | 165/166 |
| 2059567 | 4/1981 | United Kingdom | 165/165 |

*Primary Examiner*—William R. Cline
*Assistant Examiner*—John K. Ford
*Attorney, Agent, or Firm*—Pahl, Lorusso & Loud

[57] ABSTRACT

The disclosed invention relates to a counterflow type heat exchanger composed of plural heat exchange units characterized by unique inlet and outlet headers. Each header has an end face providing an opening to the header interior and a closed end face, both of which extend obliquely from the tube sheet to join at an apex and which are symmetrically arranged with respect to each other. Such a construction enables the flow of fluid passing through each heat exchange unit to be uniform across the width of the heat exchange unit.

7 Claims, 5 Drawing Figures

COUNTERFLOW HEAT EXCHANGER

BACKGROUND OF THE INVENTION

1. Field of the Invention

The present invention relates to a counterflow heat exchanger. More particularly, it is concerned with the structure of a so-called total heat exchanger in which two fluids undergo countercurrent heat exchange and provide, not only exchange of sensible heat, but also latent heat exchange involving absorption and evaporation of moisture.

2. Description of the Prior Art

Heat exchangers have been widely used in buildings, etc. for treatment of the air brought in from the outside. The so-called total heat exchanger which provides not only sensible heat exchange but also latent heat exchange, by using a heat exchange material which permits absorption, evaporation and transmission of moisture, is a recent development and is considered to be a superior heat exchanger.

However, it has been considered difficult to design such a heat exchanger with counterflow, although various attempts have been made to produce such counterflow heat exchangers. Examples of prior art, counterflow total heat exchangers are disclosed in Japanese Patent Application Laid-Open Nos. 65887/1980 and 65888/1980 and Japanese Patent Application No. 80938/1980. These prior art heat exchangers of a counterflow type employ heat exchange units such as are shown in FIG. 1 (Prior Art).

The prior art heat exchange unit illustrated in FIG. 1 includes rectangular headers b connected to both ends of heat exchanging elements a. The headers b have openings extending across half their width as indicated as c and c', respectively, and closed end wall portions d and d'. Thus, a first fluid will pass through opening c, the tube side of heat exchange elements a and opening c' as indicated by arrows p and p', while a second fluid will pass as indicated by arrows q and q' around the exteriors of the heat exchange elements a (shell side).

In operation of the heat exchange element of FIG. 1 however, the flow of the fluid passing through the inside of the heat exchange members a is non-uniform, thus causing an increased pressure drop. For example, if the fluid flows by suction in the direction of arrow p', those heat exchange elements a on the side adjacent the opening c' will carry a larger amount of fluid passing therethrough, while a lesser amount of fluid will pass through those heat exchange elements a having openings facing the closed portion d'. Due to such an offset, the potential heat exchange capacity is not fully realized, and a large pressure drop occurs.

Further, when a large number of heat exchange units, each constructed as shown in FIG. 1, are assembled into a heat exchanger by superimposing them within a casing, it is necessary to use a large amount of an adhesive or sealant in order to attain air-tightness even if a central separation frame is provided within the casing, and thus assembly of such a heat exchanger is tedious.

SUMMARY OF THE INVENTION

The present inventors have developed a countercurrent type heat exchanger in which the flow of fluid passing through each heat exchange unit is uniform across the width of the heat exchange unit.

The present invention provides a counterflow heat exchanger comprising a multitude of heat exchange units superimposed (laminated) with a predetermined spacing between adjacent units. Each heat exchange unit includes a plurality of parallel, elongated heat exchange elements, e.g., a tube bundle, with headers provided at both ends of the heat exchange elements. The headers are each provided with an oblique open end face and an oblique closed end face arranged symmetrically with respect to each other. The oblique open end face and the closed end face portions meet at an apex spaced relatively remote from the tube sheet for the heat exchange elements. From the end apex the oblique open and closed end faces taper toward side wall portions of the headers which side walls are parallel to the elongated heat exchange elements. With such a construction, the primary (tube side) fluid is distributed evenly for passage through the heat exchange elements and the secondary fluid (shell side) passes through the spacings between the heat exchange units and around the elongated heat exchange elements. The primary and secondary fluids flow countercurrently through the heat exchange unit and exit to the right and left, respectively, or vice versa, at the header open end faces. Construction of such a heat exchange unit wherein the header components are integrally molded, i.e., with an integrally molded top and bottom plates, central separator at the apex where the oblique open face and the oblique closed face meet and integrally molded header side plates, has proven to be particularly advantageous.

DESCRIPTION OF THE PREFERRED EMBODIMENTS

Preferred embodiments of the present invention are described hereinbelow with reference to the accompanying drawings to further illustrate the invention.

Figure 2:
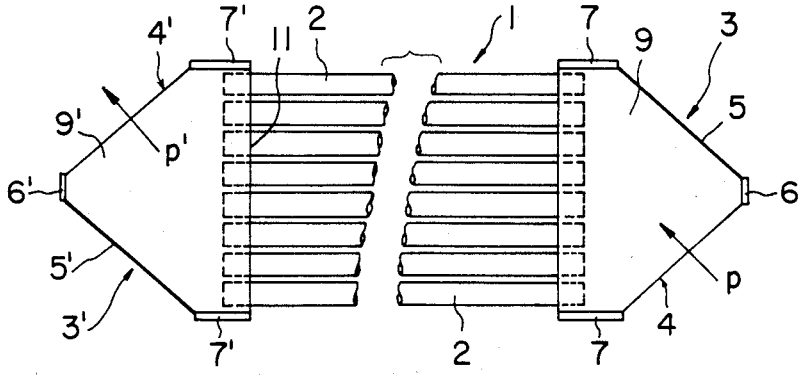
FIG. 2 is a schematic plan view showing one embodiment of a heat exchange unit in accordance with the present invention.

FIG. 2 shows a heat exchange unit 1 which includes heat exchange elements 2 which may be, for example, a large number (bundle) of tubes 2 disposed side by side, and headers 3 and 3' connected to respective ends of the tubular heat exchange elements 2. In a preferred embodiment the tubes 2 are fabricated of Kraft Paper or other material capable of adsorbing moisture from the air, thus providing "total heat exchange", i.e., exchange of both sensible and latent heat in a "total heat exchanger".

Figure 4:
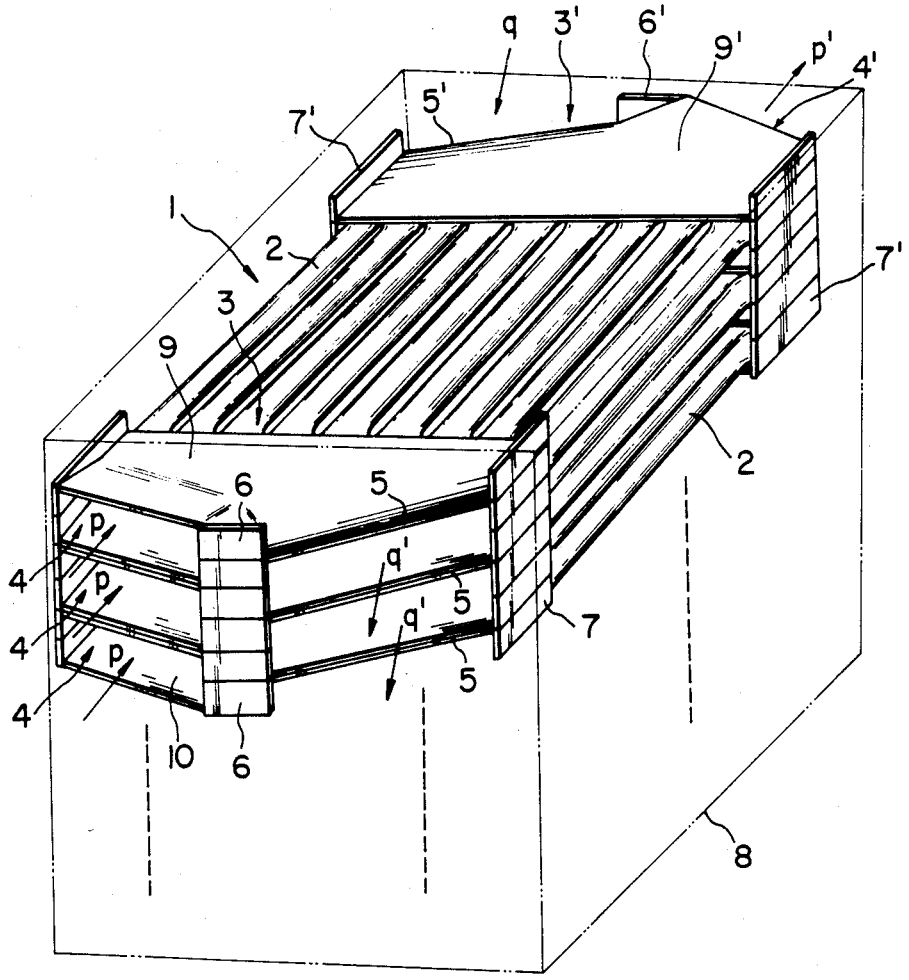
FIG. 4 is a schematic perspective view of a heat exchanger in accordance with the present invention formed of a plurality of heat exchange units as shown in FIG. 2.

The headers 3 and 3' are formed of two generally parallel, top and bottom plates 9 and 10 and 9' and 10', respectively. Plates 9 and 10, in conjunction with side plates 7 and tube sheet 11, define a space therebetween which is in fluid communication with the heat exchange tubes 2 and which serves to distribute incoming primary fluids to the various tubes 2. In like manner, plates 9' and 10', in conjunction with side plates 7' and a tube sheet (not shown), serve to define a space in which the primary (tube side) fluid emerging from the tubes 2 is collected. Plates 9 and 10 are tapered to converge toward closed side 5 and to diverge to provide opening 4. In this manner, when a plurality of such elements are stacked together as shown in FIG. 4, the spacings between closed sides 5' provide openings for flow of secondary fluid (shell side fluid) into the tube bundle, around the exteriors of tubes 2 and out through similar spacings between closed sides 5.

In the present invention, the headers 3 and 3' are provided with oblique open end faces 4 and 4' and oblique closed end faces 5 and 5'. The oblique end faces 4 and 5 and 4' and 5' meet at apexes spaced relatively remote from the tube sheets for the heat exchange elements 2. Faces 4 and 5 taper toward the side wall spacers 7 at an angle of about 40° with the central axis of the heat exchange unit 1, although any suitable angle, e.g., 30° to 60°, may be used.

The inlet, i.e, open end face 4, and the outlet, i.e., open end face 4', are aligned and therefore fluid passes therethrough in a path as indicated by arrows p and p'. Such construction enables ample flow even in the area of adjacent closed side 5 because fluid enters in an oblique direction from the oblique open face 4, and fluid which strikes the oblique closed face 5' is easily diverted due to the large striking angle and flows toward the oblique opening 4', so that the flow rate through the tubular elements 2 is uniform across the width of the heat exchange unit 1. Accordingly, areas of stagnation of fluid are eliminated and superior heat exchange is attained with low pressure drop.

Figure 3:
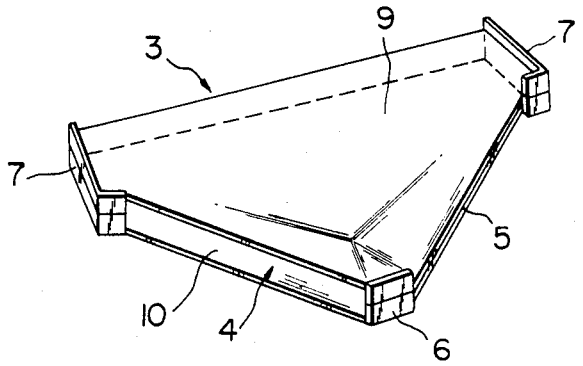
FIG. 3 is a perspective, enlarged view of the header of the heat exchange unit of FIG. 2.

FIG. 3 is a perspective view showing an example of a header used in the heat exchanger of the present invention in which a central separation wall 6 is integrally formed at the juncture of oblique open face 4 and oblique closed face 5, and side spacer plates 7 are integrally formed on both sides of the header. Such an arrangement is preferred because provision of the central separation wall 6 and side plates 7 facilitates connection of conduits to the inlet and outlet portions of each heat exchange unit 1 when a plurality of such heat exchange units 1 are assembled to form the heat exchanger of the invention. Members 6 and 7 also serve to define the spacings between the units 1. Further, the area requiring application of an adhesive for airtight lamination is minimized, and thus a very efficient assembly is attainable.

It is preferable that the fluid header 3 be formed of a synthetic resin such as, for example, an ABS resin or the like, and that the upper and lower plates 9 and 10 be provided with reinforcing ribs. Further, from the standpoint of safety, it is preferable that the header 3 be formed of a flame-retardant material.

FIG. 4 is a schematic perspective view of a gas/gas heat exchanger in accordance with the present invention. As shown in this figure, a large number of heat exchanging units 1 are superimposed with a predetermined spacing and accommodated within a casing 8 to form the heat exchanger. In this case, the primary fluid which enters the tube side of heat exchange unit 1 from the oblique opening 4 and exits from the oblique opening 4' after passing through the heat exchange elements 2, as indicated by p→p', and the secondary fluid which enters through the spacings between the oblique closed end faces 5' and exits from the spacings between the oblique closed end faces 5 after passing throughout the gaps between the heat exchange units 1 as indicated by q→q', exchange heat countercurrently. The fluids exit to the right and left sides, respectively of the central separators 6 and 6'. In operation, an inlet duct (or ducts) for fluid p is sealed (air-tight) to the front left face of the heat exchanger of FIG. 4, spanning the plural openings 4. In like manner, separate ducts are connected to each of the front right (outlet for q), rear left (inlet for q) and rear right faces of the heat exchanger.

Figure 5:
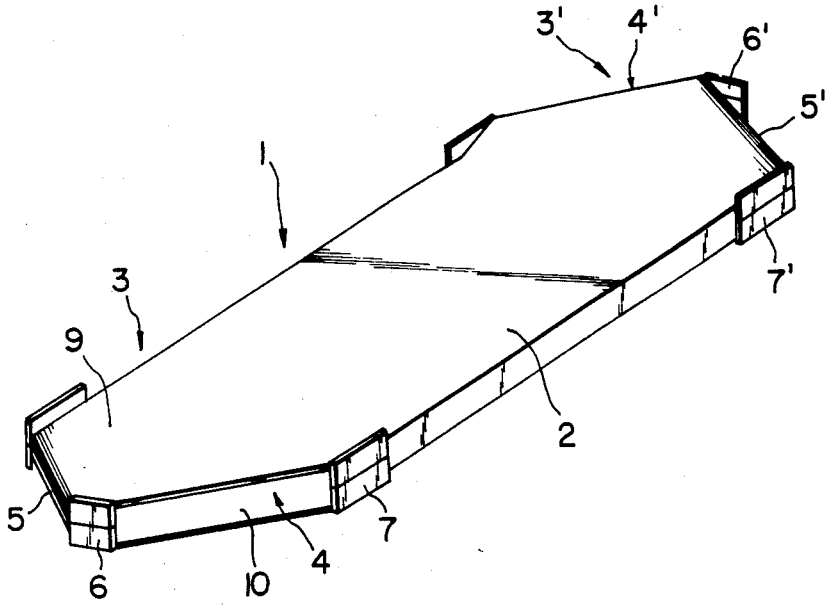
FIG. 5 is a perspective view showing another embodiment of a heat exchange unit in accordance with the present invention.

Although in FIGS. 2 through 4, the tubular members 2 and the headers 3 and 3' are formed separately and then assembled, as shown in FIG. 5, a heat exchange element 2 and headers 3 and 3' may be formed integrally with each other to form a single heat exchange element 1. The heat exchange element 2 may be in the form of parallel sheets although tubes were used in the foregoing embodiments. When members 2 are sheets, primary and secondary fluids pass alternately between the sheets.

As set forth hereinabove, the most significant feature of the present invention resides in that the fluid header is provided with an oblique opening and an oblique closed face, thereby allowing fluid to be uniformly distributed across the width of the heat exchange unit, so that the heat exchange capacity can be fully realized and the pressure drop is minimized.

It is another feature of the present invention that the headers are provided with central and side separators which provide a predetermined spacing between adjacent units and facilitate assembly or lamination of a plurality of such units.

EXAMPLE 1

Twenty-five tubes each 4 mm in diameter formed of kraft paper were arranged side by side as heat exchange elements 2, and headers 3 and 3' as shown in FIG. 3 were connected to both ends of the tubes 2 to provide a heat exchange unit 1 as shown in FIG. 2. Then, 40 of such heat exchange elements were superimposed with a spacing of about 1 mm between elements and the resultant assembly was accommodated within a casing to provide a heat exchanger such as shown in FIG. 4 having a total of 1000 kraft paper tubes.

Using the heat exchanger thus assembled, air was introduced through the tube side by suction at a rate of 4 $m^3$ per minute. As a result, the pressure drop was 10.5 mm aq.

Figure 1:
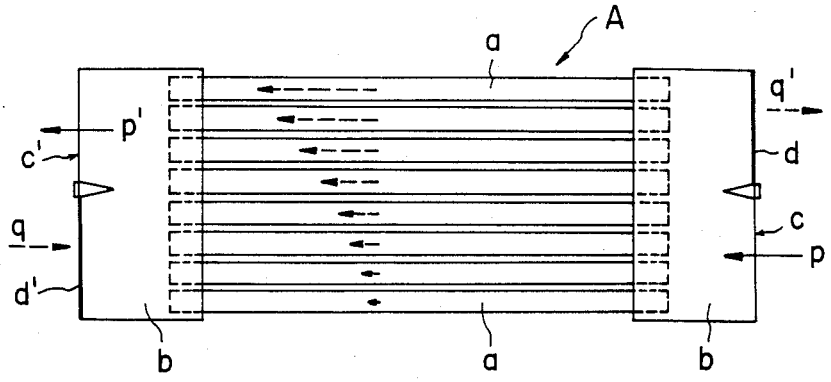
FIG. 1 PRIOR ART
FIG. 1 (prior art) is a schematic plan view of a prior art heat exchange unit of a conventional counterflow heat exchanger.

For comparison, a plurality of heat exchange units as shown in FIG. 1 were laminated and placed in a casing in the same manner as above to provide a heat exchanger of the same size, and the pressure drop was measured under the same conditions and found to be 18 mm aq., nearly twice as large as that of the heat exchanger of the present invention.

Thus, a heat exchanger according to the present invention exhibits a very low pressure drop.

EXAMPLE 2

Twenty-five tubes, each 6 mm in diameter and formed of kraft paper which had been subjected to a flame-retarding treatment, were arranged side by side as in Example 1 to provide a heat exchange unit 1 as shown in FIG. 2. Subsequently, in the same manner as in Example 1, a heat exchanger as shown in FIG. 4 having a total of 1,000 such tubes was assembled.

Using this heat-exchanger, the pressure drops through the individual tubes was measured.

In the same manner, conventional heat exchange units as shown in FIG. 1, were assembled into a heat exchanger, and the pressure drops through individual tubes were measured.

Results of the above measurements were as shown in the table below:

TABLE

| Position of Tube | Pressure Drop (mm aq) Heat Exchanger of the present invention | Heat Exchanger of the prior art |
|---|---|---|
| (Closed side) | | |
| 5th (from closed side) | 8.6 | 17.2 |
| 10th (from closed side) | 8.0 | 15.5 |
| 15th (from closed side) | 7.0 | 10.0 |
| 20th (from closed side) | 6.8 | 7.5 |
| (Open side) | | |

From the above table it is seen that in the heat exchanger of the present invention the fluid flow rate across the width of the heat exchanger is fairly uniform and the pressure drop is small and that such flow rates in the prior art heat exchanger are very non-uniform. The above data demonstrates that the heat exchanger of the present invention affords superior heat exchange.

What is claimed is:

1. A heat exchanger formed of a plurality of superimposed units sealed together, each of said units comprising:

a plurality of parallel elongated hollow heat exchange tubes;

inlet and outlet headers located at respective ends of said plurality of said elongated heat exchange tubes and in fluid communication with the hollow interiors of said heat exchange tubes;

each of said headers comprising a tube sheet perpendicular to said tubes for supporting the tubes at one end, top and bottom plate members, and said plate members forming flow directing means for directing incoming tube side fluid along a path toward said tube sheet oblique with respect to said tube sheet, said flow directing means including an end face defining an opening to the header interior and a closed end face, said end face defining said opening and said closed end face being joined at an apex and extending obliquely from said apex toward said tube sheet;

wherein said top and bottom plate members define surfaces which are gradually and continuously sloped both to converge toward each other at said closed end face and to diverge toward said opening; and wherein the end faces providing said openings are sealed to like adjacent end faces to prevent fluid flow therebetween and said closed end faces are spaced apart to allow sheet side fluid to enter and exit therebetween in a direction oblique to said tube sheet while passing in contact with the exteriors of said elongated heat exchange tubes.

2. The heat exchanger of claim 1 wherein each of said headers additionally comprises side wall portions extending between said tube sheet and said end faces.

3. The heat exchanger of claim 1 wherein each of said tube sheets is generally rectangular in cross-section.

4. A heat exchanger in accordance with claim 1 wherein each of said closed end face and said end face defining said opening are arranged at an angle of 30° to 60° with respect to the central axis of the heat exchange unit.

5. A heat exchange unit in accordance with claim 4 wherein said angle is about 40°.

6. A heat exchanger in accordance with claim 1 fabricated of a material capable of adsorbing moisture from the air and thereby capable of exchange of both sensible and latent heat.

7. A heat exchanger in accordance with claim 6 wherein said material is Kraft paper.

* * * * *